US005101541A

United States Patent [19]

Watanabe

[11] Patent Number: 5,101,541

[45] Date of Patent: Apr. 7, 1992

[54] SNAP BUTTON

[75] Inventor: Hirokazu Watanabe, Kurobe, Japan

[73] Assignee: Yoshida Kogyo K.K., Tokyo, Japan

[21] Appl. No.: 742,003

[22] Filed: Aug. 8, 1991

[30] Foreign Application Priority Data

Aug. 10, 1990 [JP] Japan ..... 2-84619[U]

[51] Int. Cl.[5] ..... A44B 17/00

[52] U.S. Cl. ..... 24/674; 24/90 C; 24/689

[58] Field of Search ..... 24/674, 673, 675, 676, 24/677, 689, 691, 90 C, 93, 104, 106

[56] References Cited

U.S. PATENT DOCUMENTS 1,678,240 7/1928 Benz ..... 24/674
2,080,379 5/1937 Reiter ..... 24/674
2,134,037 10/1938 Fenton ..... 24/674
2,552,764 5/1951 Bedford, Jr. ..... 24/674
4,698,881 10/1987 Watanabe ..... 24/674

*Primary Examiner*—Victor N. Sakran
*Attorney, Agent, or Firm*—Hill, Van Santen, Steadman & Simpson

[57] ABSTRACT

A snap button for attachment to a garment fabric comprises a socket member, a plug member snappingly engageable therewith and a spring member accommodated in the socket. The socket member includes a cylindrical hub and a bottomless collet having an annular flange which has a plurality of ridges adapted to be folded radially inwardly over the spring and over the hub, respectively.

3 Claims, 2 Drawing Sheets

SNAP BUTTON

BACKGROUND OF THE INVENTION

1. Field of the Invention

This invention relates to a snap button having a female component and a male component engageable snappingly therewith for fastening the button to a garment fabric such as of an apparel, sports wear, bags and the like.

2. Prior Art

There are known a variety of buttons of the character mentioned. A typical prior art button in and relating to which the present invention contemplates improvements comprises a cylindrical hub 100 having its bottom peripheral edge 100*a* inwardly directed to receive thereon an annular spring 101 and an annular sleeve 102 adapted to receive therein the hub 100. The hub 100 upon engagement with the sleeve 102 is passed through a web of fabric 103 and secured thereto with its upper peripheral edge 100*b* folded outwardly over the sleeve 102 as shown in FIG. 5 of the accompanying drawing. This prior art button disclosed in Japanese Utility Model Laid-Open Publication No. 2-23811 has a drawback in that it requires two separate tools to mount the spring 101 and to insert the hub 100 into the sleeve 102 in respective different modes of operation and is therefore extremely time-consuming and tedious.

SUMMARY OF THE INVENTION

It is a primary object of the present invention to provide improvements in and relating to a snap button whereby the foregoing difficulties of the prior art will be eliminated or alleviated.

A more specific object of the invention is to provide a snap button which can be assembled easily and efficiently without having to move or displace its component parts relative to a garment fabric to which the button is attached.

According to the invention, there is provided a snap button for attachment to a garment fabric which comprises: a socket member comprising a cylindrical collet having a central through opening, an annular flange extending radially outwardly from the collet, a cylindrical hub having its lower marginal edge flared to form an anchoring lug and an annular spring larger in diameter than the opening; and a plug member having an enlarged head portion, a reduced neck portion and a horizontally extending leg portion; the annular flange being provided on its upper surface with a plurality of relatively long upwardly projecting first ridges spaced circumferentially adjacently around the opening and a plurality of relatively short upwardly projecting second ridges spaced circumferentially adjacently around an outer peripheral edge of the flange, the first ridges being adapted to be folded radially inwardly over the spring and the second ridges being adapted to be folded radially inwardly over the anchoring lug.

The above objects and features of the invention will be better understood from the following detailed description when read in connection with the accompanying drawings.

DETAILED DESCRIPTION OF THE INVENTION

Figure 1:
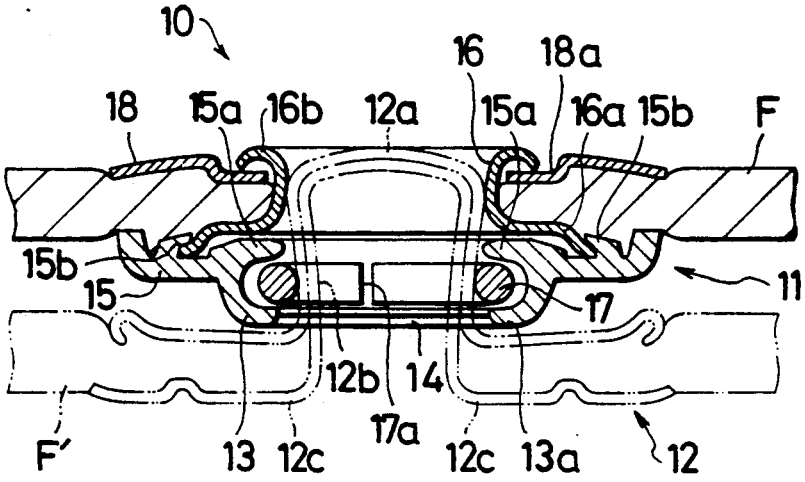
FIG. 1 is a cross-sectional view of a snap button embodying the invention and shown attached to a garment fabric.

Referring now to the drawings and FIG. 1 in particular, there is shown a snap button 10 which essentially comprises a female or socket member 11 and a male or plug member 12 engageable therewith across a web of garment fabric F.

The socket member 11 may be made of a metallic or plastics material and is comprised of a cylindrical bottomless collet 13 of a relatively short profile having a central through opening 14 and an annular flange 15 extending radially outwardly integrally from the body of the collet 13, a cylindrical hub 16 having its lower marginal edge flared to form an anchoring lug 16*a* and an annular spring 17 having a slit 17*a* and larger in diameter than the opening 14. The collet 13 has its lower marginal edge bent radially inwardly to form a seat 13*a* for supporting the spring 17.

Figure 3:
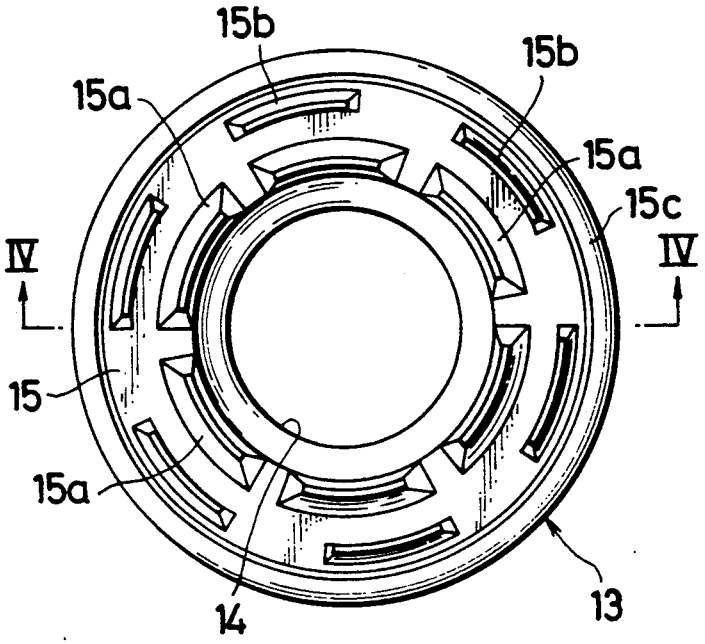
FIG. 3 is a plan view on enlarged scale of a female or socket member of the button.
Figure 4:
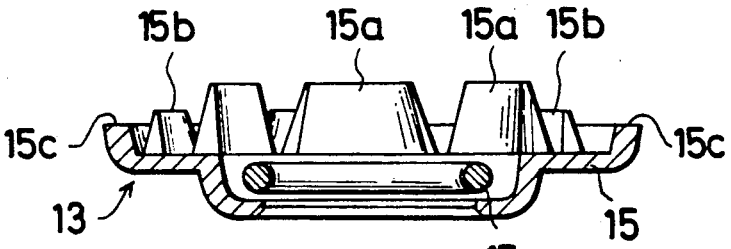
FIG. 4 is a cross-sectional view taken on the line IV—IV of FIG.
Figure 5:
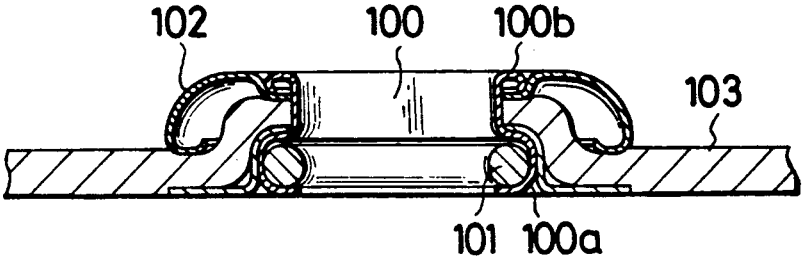
FIG. 5 PRIOR ART
FIG. 5 is a cross-sectional view of a prior art button.

As better shown in FIGS. 3 and 4, the annular flange 15 of the collet 13 in its original unassembled form is provided on its upper surface with a plurality of upwardly projecting, relatively long first ridges 15*a* equally spaced circumferentially adjacently around the opening 14 and a plurality of upwardly projecting, relatively short second ridges 15*b* equally spaced circumferentially adjacently around an outer peripheral edge 15*c* which is likewise projecting upwardly from the flange 15.

The male or plug member 12, which may be also made of a metallic or plastics material, has a circular cross-section and is provided with an enlarged head portion 12*a*, a reduced neck portion 12*b* and a pair of horizontally extending leg portions 12*c* adapted to grip therebetween a lining strip of fabric F' as indicated by phantom line in FIG. 1. The head portion 12*a* of the plug member 12 has an outer diameter substantially equal to an inner diameter of the cylindrical hub 16 to fit snugly therewith, but larger than an outer diameter of the spring 17 so as to expand the latter when inserting the plug 12 therethrough and allow the same to resiliently hold the neck portion 12*b* in place when the plug 12 is fully inserted as shown in FIG. 1.

Figure 2:
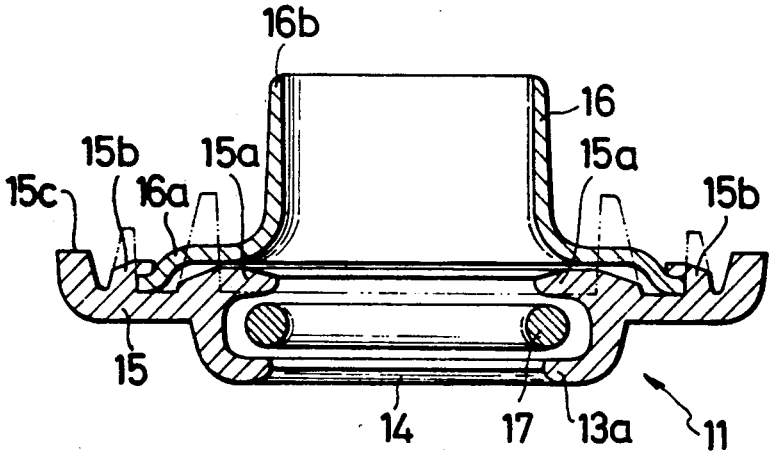
FIG. 2 is a cross-sectional view of the socket member shown being assembled.

When assembling the snap button 10 thus constructed, the socket member 11 is placed on a working table not shown, followed by mounting the spring 17 from above through the upper end of the opening 14 of the collet 13 which is at this stage larger than the spring 17. The first ridges 15*a* of the flange 15 are then folded radially inwardly over the spring 17 from the phantom-line position to the solid-line position as shown in FIG. 2. Thereafter, the cylindrical hub 16 is mounted on the collet 13, followed by folding the second ridges 15*b* of the flange 15 radially inwardly over the anchoring lug 16*a* of the hub 16 from the phantom-line position to the solid-line position as shown in FIG. 2, thereby clamping the hub 16 in place relative to the collet 13. The fabric F is placed over the socket member 11 on the working table and passed through the hub 16 from above, followed by mounting an annular washer 18 over the fabric F through the hub 16. Thereafter, the upper marginal edge 16*b* of the hub 16 is folded radially outwardly over the washer 18 to clamp the socket member 11 in place relative to the fabric F as shown in FIG. 1. The washer 18 is circumferentially recessed to form a seat 18*a* against which the socket member 11 is folded and rested, when the folded edge thereof lies substantially flush with and not beyond the upper surface of the washer 18. With the socket member 11 thus assembled relative to the fabric F, the plug member 12 already attached to the lining strip F′ is now inserted into the socket 11, in which instance the spring 17 initially expands on contact with the head portion 12*a* and then contracts after the head portion 12*a* is fully inserted in the hub 16, thereby resiliently holding the neck portion 12*b* in position against displacement as shown in FIG. 1.

Obviously, various modifications and variations of the present invention are possible in the light of the above teaching. It is therefore to be understood that within the scope of the appended claims the invention may be practiced otherwise than as specifically described.

What is claimed is:

1. A snap button for attachment to a garment fabric which comprises:

(a) a socket member comprising:

(i) a cylindrical collet having a central through opening;

(ii) an annular flange extending radially outwardly from said collet;

(iii) a cylindrical hub having its lower marginal edge flared to form an anchoring lug; and (iv) an annular spring larger in diameter than said opening; and (b) a plug member having an enlarged head portion, a reduced neck portion and a horizontally extending leg portion; said annular flange being provided on its upper surface with a plurality of relatively long upwardly projecting first ridges spaced circumferentially adjacently around said opening and a plurality of relatively short upwardly projecting second ridges spaced circumferentially adjacently around an outer peripheral edge of said flange, said first ridges being adapted to be folded radially inwardly over said spring and said second ridges being adapted to be folded radially inwardly over said anchoring lug.

2. A snap button according to claim 1 further including an annular washer having a recessed seat over which an upper marginal edge of said hub is folded radially outwardly.

3. A snap button according to claim 1 wherein said first and second ridges, respectively are spaced equally apart from one another circumferentially around said flange.

* * * * *